United States Patent [19]

Bryson et al.

[11] 3,941,680

[45] Mar. 2, 1976

[54] LUBE OIL HYDROTREATING PROCESS

[75] Inventors: Millard C. Bryson, Conway; Harry C. Murphy, Jr., Apollo, both of Pa.; James R. Murphy, Houston, Tex.; Harry C. Stauffer, Cheswick, Pa.

[73] Assignee: Gulf Research & Development Company, Pittsburgh, Pa.

[22] Filed: Oct. 20, 1971

[21] Appl. No.: 190,961

[52] U.S. Cl. ..... 208/80; 208/18; 208/59; 208/78; 208/111

[51] Int. Cl.[2] C10G 41/00; C10G 13/08; C10G 37/02

[58] Field of Search ..... 208/80, 78, 59

[56] References Cited

UNITED STATES PATENTS

| | | | |
|---|---|---|---|
| 2,526,068 | 10/1950 | Delattre-Seguy | 196/52 |
| 3,243,367 | 3/1966 | Mason et al. | 208/59 |
| 3,254,020 | 5/1966 | Frayer et al. | 208/89 |
| 3,579,435 | 5/1971 | Olenzak et al. | 208/59 |
| 3,637,483 | 1/1972 | Carey | 208/86 |
| 3,663,423 | 5/1972 | Bennett et al. | 208/59 |

*Primary Examiner*—Herbert Levine
*Assistant Examiner*—G. E. Schmitkons

[57] ABSTRACT

A process for the production of lubricating oil in order to obtain lower viscosity lubricating oils of increased viscosity index by separating a crude lubricating oil into a residual fraction and a distillate fraction and thereafter subjecting the residual fraction to hydrotreating and separately subjecting the distillate fraction to hydrotreating under more severe conditions than employed in hydrotreating the residual fraction.

3 Claims, 3 Drawing Figures

Figure 1:
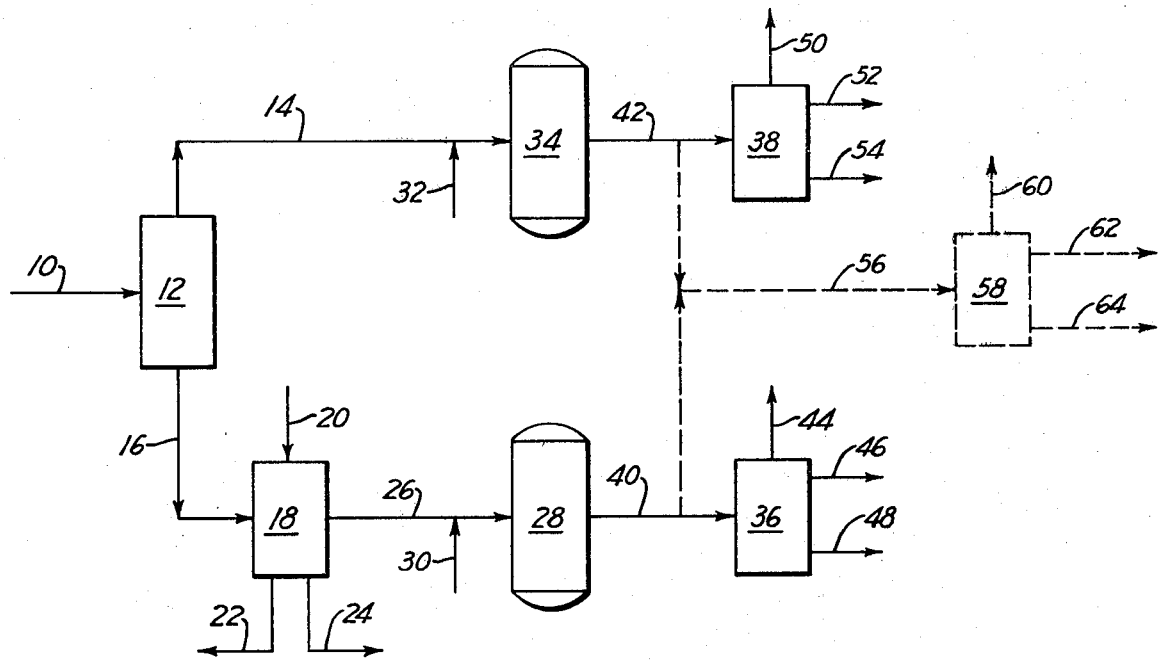

INVENTORS.
MILLARD C. BRYSON
HARRY C. MURPHY
JAMES R. MURPHY
HARRY C. STAUFFER

LUBE OIL HYDROTREATING PROCESS

Our invention relates to the production of lubricating oils wherein comparatively low viscosity lubricating oils of enhanced viscosity index are obtained. More particularly, our invention relates to the process of producing such lubricating oils by hydrotreating wherein crude lubricating oil is fractionated to provide a residual fraction and a distillate fraction and wherein the distillate fraction is separately subjected to hydrotreating under more severe conditions than employed in the hydrotreating of the residual fraction.

It has been previously suggested in the art to subject hydrocarbon fractions boiling in the lubricating oil range to various treatments with hydrogen in order to provide lubricating oil base stocks meeting desired specifications, such as, for example, viscosity, viscosity index (VI), pour point and acceptable contaminant levels. These hydrogen treatment techniques are designated by a variety of terms whose definitions tend to overlap depending upon the individual employing such terms. Regardless of the inadequacy of nomenclature in this area, these hydrogen treatment processes can be categorized into four different groups. We chose to term these categories as hydrocracking, hydrotreating, hydrogenation and hydrofinishing.

As employed herein the term "hydrocracking" is meant to describe an extremely severe hydrogen treatment, usually conducted at comparatively high temperatures and requiring the employment of a catalyst having substantial cracking activity, e.g., an activity index (AI) greater than 40 and generally greater than 60. This type of process is conducted to effect extensive and somewhat random severing of carbon to carbon bonds resulting in a substantial overall reduction in molecular weight and boiling point of treated material. Thus, for example, hydrocracking processes are generally employed to effect an extremely high conversion, e.g., 90% by volume, to materials boiling below the boiling range of the feed stock or below a designated boiling point. Usually a hydrocracking process is employed to produce a product boiling predominantly, if not completely, below about 600° to 650°F. Most frequently this type of process is employed to convert higher boiling hydrocarbons into products boiling in the furnace oil and naphtha range. When applied in connection with lubricating oils, hydrocracking processes produce only a minor quantity of materials boiling in the lubricating oil range, i.e., 625° to 650°F.+, to the extent that, at times, the production of a lubricating oil is merely incidental to the production of naphtha and furnace oil. Hydrocracking is the most severe of the four types of processes mentioned above.

On the other end of the spectrum, "hydrofinishing" is an extremely mild hydrogen treatment process employing a catalyst having substantially no cracking activity. This process effects removal of contaminants such as color forming bodies and a reduction of minor quantities of sulfur, oxygen and nitrogen compounds, but effects substantially no saturation of unsaturated compounds such as aromatics. This process, of course, effects no cracking. As a general rule, hydrofinishing is employed in lieu of the older techniques of acid and clay contacting.

A third type of hydrogen treatment process is "hydrogenation" which, as employed herein, describes another comparatively mild process. Hydrogenation, although being comparatively mild, is more severe than hydrofinishing and generally effects saturation of unsaturated materials such as aromatics. A hydrogenation process is also capable of removing somewhat larger quantities of contaminants such as sulfur. A hydrogenation process is conducted with a catalyst having substantially no cracking activity and accordingly does not produce any significant reduction in boiling point of the material treated over and above that which might be effected from sulfur removal alone. Accordingly, therefore, a hydrogenation process is employed, albeit infrequently, in the area of lubricating oil production in order to effect saturation of aromatics and removal of sulfur from a charge stock already boiling within the lubricating oil range without the production of any lower boiling materials.

As distinguished from hydrocracking, hydrofinishing and hydrogenation, the term "hydrotreating" is employed herein to describe a processing technique significantly more severe than hydrogenation although substantially less severe than hydrocracking. The catalyst required in a hydrotreating process must possess cracking activity and generally possess a particular type of activity termed "ring scission activity". The degree of cracking and ring scission activity is dependent upon feedstock and product desired. Thus, a hydrotreating process effects a substantial molecular rearrangement as compared to hydrogenation or hydrofinishing but does not effect the extensive and somewhat random breakdown of molecules effected in hydrocracking. Accordingly, this type of process effects substantially complete saturation of aromatics and the reactions are believed to follow the course of converting condensed aromatics to condensed naphthenes followed by selective cracking of the condensed naphthenes to form single ring alkylnaphthenes. Thus, polynuclear cyclic compounds are attacked and the rings are opened, while mononuclear cyclic compounds are not substantially affected. The alkyl side chains formed by opening the rings are not further reacted to sever the alkyl side chains. Hydrotreating processes are also effective for the isomerization of paraffins. As with the less severe hydrogenation process and the more severe hydrocracking process, hydrotreating is also effective to remove contaminants such as sulfur, nitrogen and oxygen. Thus, a hydrotreating process removes contaminants, reduces the quantity of aromatics and polynuclear cyclic compounds and increases the quantity of paraffins, thereby enhancing the quality of the material treated, reducing its bromine number and increasing its VI.

A hydrotreating process can also be identified by the fact that the particular combination of operating conditions and catalyst selected to accomplish the above-mentioned results produces a product wherein there is a general decrease in VI from the highest viscosity fraction to the lowest viscosity fraction of the lubricating oil. While at times the rate of decrease in VI with decreasing viscosity may be extremely slight or even non-existent among extremely high viscosity fractions, the rate of decrease in VI tends to become greater as the viscosity of the lubricating oil fraction decreases. Usually, this decrease in VI with decreasing viscosity is particularly pronounced among the lighter lubricating oils having the lowest viscosities, such as, for example, materials whose viscosity is usually measured in Saybolt Universal Seconds (SUS) at 100°F. Additionally, this phenomenon is evidenced quite drastically in hydrotreated lubricating oil products having viscosities of less than about 300 SUS at 100°F. and obtained from distillate charge stocks. This is not to say, however, that the decrease in VI with decreasing viscosity cannot be seen quite clearly in the hydrotreated products of residual stocks whose viscosities, at times, are more conveniently measured in SUS at 210°F.

The particular operation involved in the process of our invention is hydrotreating as distinguished from hydrofinishing, hydrogenation and hydrocracking. The material normally charged to a hydrotreating operation can be termed a "crude lubricating oil stock" and is generally obtained from crude petroleum by distillation so as to provide a material boiling at least above about 600°F. and preferably above about 625° to 650°F. Depending upon the crude petroleum from which the crude lubricating oil stock is obtained, such material may be subjected to a pretreatment such as solvent extraction prior to being charged to a hydrotreating operation. Within the overall boiling range of crude lubricating oils, we term materials boiling up to about 950° to 1000°F. as "distillates" or "distillate crude lubricating oil stocks" while we term the portions boiling above about 950° to 1000°F. "residuals" or "residual crude lubricating oil stocks". In connection with residual crude lubricating oils, it may be desirable, depending upon the source of the crude, to subject such material to deasphalting such as, for example, propane deasphalting, prior to charging it to a hydrotreating process. The products from hydrotreating operations can be fractionated and blended with each other to produce desired lubricating oil products and in some instances, depending upon specific end uses of the lubricating oils, such materials can be subjected to finishing operations, such as acid and clay contacting or the hydrofinishing treatment described previously.

In the petroleum refinery field generally, and particularly with processes effecting any substantial molecular rearrangement of the material being treated, it is usually anticipated that the heavier or higher boiling feed stocks must be treated at more severe conditions than those employed for the treatment of a lighter or lower boiling feed stock. From this it follows that the severity of the operation is in many instances determined by the severity required to effect molecular rearrangement of the heavier components in the feed stock. We have found, however, that in the area of hydrotreating a wide boiling lubricating oil fraction that the severity of the operation is limited by the tendency of the higher boiling components, e.g., materials boiling above 950° to 1000°F., to crack into extremely low boiling, e.g., less than 650° or 600°F., less valuable non-lubricating oil materials at conditions of high severity. Consequently, the severity of a hydrotreating operation must be adjusted to avoid such cracking or hydrocracking. This restriction on severity limits the possible increase in VI for the lower viscosity, lower boiling, e.g., boiling below 950° to 1000°F., portions of the charge stock thereby producing lower viscosity lubricating oils of undesirably low VI. In many instances the VI of such low viscosity lubricating oil base stocks is too low to meet even minimum specifications for given lubricating oils.

Accordingly, our invention provides a process for producing lower viscosity lubricating oils of increased VI. In accordance with our invention, a crude lubricating oil, preferably, a wide boiling crude lubricating oil, containing components boiling both above and below 950°F. is fractionated to obtain a distillate fraction and a residual fraction. The residual fraction is subjected to hydrotreating, preferably employing conditions which avoid production of significant quantities of materials boiling below the lubricating oil boiling range. The distillate fraction is separately subjected to hydrotreating under more severe conditions than employed in hydrotreating the residual fraction, preferably under conditions for optimizing increase in VI. The hydrotreated crude lubricating oils are then recovered as lubricating oil base stock product. In this connection, it should be pointed out that the hydrotreated residual fraction and the hydrotreated distillate fraction can be fractionated separately or can be combined and fractionated in one unit so as to separate the lubricating oil base stock product from any decomposition product boiling below the lubricating oil range which might be formed during hydrotreating. Such fractionation can also be conducted so as to provide a plurality of lubricating oil base stock fractions suitable for blending with each other or with other stocks.

The crude lubricating oil feed stock suitable for employment in our invention can be any lubricating oil boiling range material which contains a significant quantity of both distillate compounds and residual compounds. Thus a crude lubricating oil containing from about 10% to about 90% by volume distillate component and containing from 90% to 10% by volume residual components can be treated advantageously in accordance with our invention. Greater benefit can be obtained from our invention, however, if the crude lubricating oil base stock is comprised of a substantial quantity of both residual components and distillate components such as, for example, at least about 25% by volume each of distillate and residual components.

The catalyst employed in the process of our invention is a dual functional catalyst comprised of a hydrogenating component on a cracking carrier. Suitable catalysts include metalliferous hydrogenating components selected from the group consisting of Group VI and Group VIII metals, their oxides and sulfides supported on a carrier having cracking activity. Suitable cracking carriers include those having an Activity Index of at least about 15. Carriers having an Activity Index which is comparatively high, e.g., greater than about 60, are also quite satisfactory. Conversely, we have found that in some employments carriers having an Activity Index of less than about 20 and even less than about 18 can be utilized satisfactorily. Illustrative of these catalysts are those containing a plurality of hydrogenating components such as combinations of nickel, cobalt and molybdenum; nickel and tungsten; cobalt and molybdenum, etc. supported on refractory metal oxide carriers. Suitable carriers can be comprised of a single oxide or a plurality of such oxides, e.g., alumina, silica-alumina, silica-magnesia, silica-zirconia, silica-alumina-mangesia, etc. We have found a catalyst comprised of nickel and tungsten hydrogenating components supported on a silica-alumina carrier to be quite satisfactory. Additionally, all of these catalysts can be promoted by the addition thereto of a small quantity of halogen in the range from about 0.1 to about 10% by weight based on the total catalyst, and preferably from about 1 to about 4% by weight based upon the total catalyst. We prefer to employ a catalyst containing from about 1 to 3% by weight of fluorine based on the total catalyst.

The operating conditions employed in the low severity hydrotreating of a residual fraction in accordance with our process include a temperature in the range from about 650° to about 850°F. and preferably from about 700° to 800°F; a pressure (hydrogen partial pressure) in the range from about 2,000 to about 10,000 psig and preferably in the range from about 2,000 to about 5,000 psig; a liquid hourly space velocity (LHSV) in the range from about 0.1 to about 10, preferably from about 0.5 to about 3.0 volumes of residual crude lubricating oil feed stock per volume of catalyst per hour, and a hydrogen feed rate in the range from about 2,000 to about 10,000 standard cubic feet per barrel (SCF/B) and preferably in the range from about 3,000 to about 6,000 SCF/B. It is not necessary to employ pure hydrogen gas in this operation but it is desirable to maintain a hydrogen purity of at least 50% by volume and preferably of at least 75% by volume. Thus, impure hydrogen streams of the type generally found in a refinery such as, for example, reformer off-gas, containing from 70 to 90% by volume hydrogen are quite satisfactory.

The reaction conditions suitable for employment in the high severity hydrotreating of a distillate fraction in accordance with our process include a temperature in the range from 700° to 900°F. and preferably from about 750° to 850°F. It is essential, however, that the temperature employed in hydrotreating the distillate stock in accordance with our invention be maintained at least 10°F. higher than the temperature employed in hydrotreating the residual fraction. Preferably, we employ a temperature in the distillate hydrotreating at least 15°F. higher than employed in the residual hydrotreating. The other operating conditions employed in the high severity hydrotreating of the distillate fraction include a pressure in the range from about 2,000 to about 10,000 psig and preferably in the range from about 2,500 to about 5,000 psig; LHSV from about 0.1 to about 10 and preferably from 0.5 to 3; a hydrogen feed rate in the range from 2,000 to 10,000 SCF/B of distillate feed stock and preferably from 3,000 to 6,000 SCF/B. The purity of the hydrogen stream can be the same as described previously for the residual hydrotreating step.

Further, we prefer to employ operating conditions in our hydrotreating operations selected from the above-described ranges so as to obtain a yield of at least 50% by volume based upon total reactor charge stock of 625°F.+ material. Accordingly, the operating conditions are selected so that at reactor outlet conditions the 625°F.+ material comprises at least 22 mol % of the product which is normally liquid at 60°F. and one atmosphere. Furthermore, operating conditions are selected so that the actual hydrogen consumption (measured as standard cubic feet per barrel of fresh feed) is less than the product of 30 multiplied by the volume % (measured at 60°F. and one atmosphere) of 625°F.+ material in the total $C_{5+}$ reactor effluent.

Figure 2:
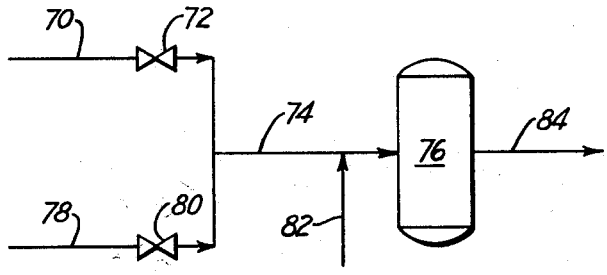
Figure 3:
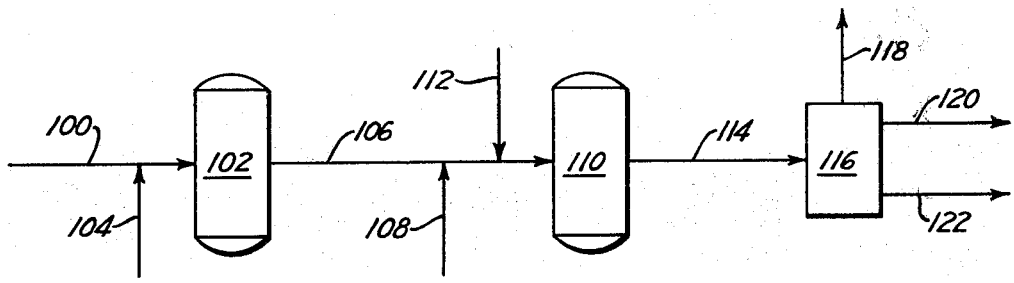

From the foregoing description, it will be seen that an essential part of our invention is to subject the distillate portion of a lubricating oil to hydrotreating under more severe conditions than employed in hydrotreating the residual portion of the lubricating oil. This is not to say, however, that it is in any way detrimental to subject a distillate lubricating oil fraction to hydrotreating under the mild conditions employed for the residual fraction so long as the distillate fraction is also subjected to hydrotreating under more severe conditions. Accordingly, therefore, the process of our invention can be practiced through the technique of blocked operation wherein the distillate portion and the residual portion of the lubricating oil are separately subjected to hydrotreating in the same reaction zone but at different times and at different levels of severity. Similarly, our inventive process can be practiced employing parallel reactors, in one reactor of which the distillate fraction is treated at comparatively severe conditions, while the residual fraction is simultaneously being treated at less severe conditions in another reactor. The hydrotreating products from such parallel reactors can then be combined and subjected to a single fractionation to obtain the various desired lubricating oil product fractions. In still another embodiment of our process, it is possible to employ reactors in series wherein the distillate fraction is subjected to hydrotreating under comparatively severe conditions in one reactor and thereafter the hydrotreated effluent of such reactor can be combined witih the residual fraction and the combined stream can then be subjected to hydrotreating under less severe conditions. These different modes of operation are illustrated in the attached drawing wherein FIG. 1 is a schematic flow diagram illustrating parallel operation; FIG. 2 is a schematic flow diagram illustrating blocked operation; and FIG. 3 is a schematic flow diagram illustrating a series operation.

In FIG. 1, a full range crude lubricating oil boiling upwards from about 650°F. and containing substantial components boiling above about 950°F. is passed by means of line 10 to a vacuum distillation unit 12 wherein it is separated into a 650° to 950° to 1000°F. distillate fraction, which is removed overhead via line 14, and a residual fraction boiling above about 950° to 1000°F., which is removed via line 16. The residual fraction of line 16 is introduced into a deasphalting unit 18, such as a propane deasphalter. In the drawing, block 18 represents a conventional deasphalting unit and merely shows introduction of solvent by means of line 20, removal of asphalt by means of line 22 and removal of separated solvent by means of line 24. Deasphalted residual fraction is removed from deasphalting unit 18 by means of line 26 and is passed to a hydrotreating reactor 28, which contains a suitable catalytic material, such as, for example, nickel and tungsten supported on a silica-alumina carrier and promoted with a halogen. Prior to introduction of the residual fraction of line 26 into reactor 28, hydrogen is introduced into line 26 by means of line 30 and the combined hydrogen and residual fraction is contacted with the catalyst in reactor 28 under selected hydrotreating conditions.

Similarly, hydrogen is introduced into line 14 and is combined with the distillate fraction of line 14 and the combined stream is then introduced into a second hydrotreating reactor 34 wherein the combined stream is contacted with a suitable hydrotreating catalyst such as that employed in reactor 28, but under selected hydrotreating conditions more severe than those employed in reactor 28.

The effluent from hydrotreating reactors 28 and 34 is then removed therefrom and passed to separate fractionation or stripping towers 36 and 38, respectively, by means of lines 40 and 42, respectively. In stripper or fractionator 36, the hydrotreated effluent of line 40 is separated into a gas stream containing hydrogen and gaseous hydrocarbons, a hydrocarbon stream boiling below the lubricating oil range, e.g., below about 650°F., and a lubricating oil product stream; which streams are shown being removed via lines 44, 46 and 48, respectively. Similarly, the hydrotreated effluent of line 42 is separated in stripper or fractionator 38 into a gas stream, a lower boiling hydrocarbon stream and a lubricating oil product stream, shown as being removed via lines 50, 52 and 54, respectively.

Alternatively, the hydrotreated effluent streams of lines 40 and 42 can be combined in line 56 (shown in dotted lines) and passed to a single stripper or fractionator 58 (also shown in dotted lines) wherein the combined hydrotreated effluent stream of line 56 can be separated into a gas stream, a light hydrocarbon stream and a lubricating oil product stream shown as being removed from fractionator 58 via lines 60, 62 and 64, respectively, (also shown in dotted lines).

In FIG. 2, there is illustrated an embodiment of our process employing blocked operation. In this figure, distillate lubricating oil is introduced via line 70 containing valve 72 and is then passed via line 74 into reactor 76. Similarly, a residual fraction, such as deasphalted oil, is introduced by line 78 containing valve 80 and is then passed via line 74 into reactor 76. Prior to the introduction into reactor 76, the hydrocarbon stream of line 74 is admixed with hydrogen introduced via line 82.

During one period of operation, valve 72 is maintained in the open position, while valve 80 is maintained in the closed position thereby permitting the passage of distillate fraction through line 70, valve 72 and line 74 into hydrotreating reactor 76 wherein it is contacted with an appropriate catalyst in admixture with hydrogen. The hydrotreated effluent from reactor 76 is then removed via line 84 and passed to a stripper or fractionator (not shown) in substantially the same manner as described previously in connection with FIG. 1.

When it is desired to treat a residual fraction, valve 72 is closed and valve 80 is opened thereby permitting the passage of residual fraction through line 78, valve 80 and line 74 into hydrotreating reactor 76 wherein it is contacted with a suitable catalyst while in mixture with hydrogen. The hydrotreating conditions employed for the treatment of the residual fraction are, of course, less severe than those employed for treatment of the distillate fraction. Again, the hydrotreated effluent from reactor 76 is removed therefrom via line 84 and passed to a stripper or fractionator (not shown).

Referring now to FIG. 3, there will be seen an embodiment of our process employing reactors in series. In this figure, distillate lubricating oil boiling below 950°F. is introduced by line 100 into hydrotreating reactor 102. Prior to introduction into the reactor 102, the distillate fraction of line 100 is admixed with hydrogen introduced into the system via line 104. In reactor 102, the distillate fraction in admixture with hydrogen is contacted under selected hydrotreating conditions with an appropriate catalyst. The hydrotreated effluent of reactor 102 is removed therefrom by means of line 106. A residual lubricating oil fraction, such as a deasphalted oil, is introduced into the system via line 108 and is combined with the effluent stream of line 106 and this combined residual fraction and hydrotreated distillate effluent stream is then introduced into a second hydrotreating reactor 110. If desired, additional hydrogen can also be introduced into the system via line 112 and admixed with the combined residual fraction and hydrotreated distillate effluent from reactor 102 prior to introduction into reactor 110. The hydrotreated effluent from reactor 110 is removed therefrom via line 114 and passed to stripper or fractionator 116 wherein it is separated into a gaseous stream, a hydrocarbon stream boiling below the lubricating oil range, e.g., below about 650°F., and a lubricating oil product stream. These three streams are shown as being removed from stripper or fractionator 116 by means of lines 118, 120 and 122, respectively.

In order to illustrate our invention in greater detail, reference is made to the following examples:

EXAMPLE 1

In this example, the feed stock employed was a comparatively wide boiling range crude lubricating oil containing components boiling both above and below about 950°F. and having the inspections set forth in Table I below:

Table I

| | | |
|---|---|---|
| Gravity °API | | 19.6 |
| Vis SUS | | |
| at 150°F. | 334 | |
| at 210°F. | | 99.7 |
| Distillation | | |
| ASTM D-1160°F., | 10% | 861 |
| | 30% | 909 |
| | 50% | 956 |
| | 70% | 1013 |
| | 90% | — |

Different samples of this crude lubricating oil were subjected to different hydrotreating techniques. In the first operation, one sample of the entire crude lubricating oil, i.e. both distillate and residual components, was subjected to hydrotreating employing a temperature dictated by the consideration of conversion of residual components. In a second operation, a second sample of the entire crude lubricating oil was subjected to hydrotreating employing a temperature dictated by the consideration of increasing the VI of the lower viscosity product fractions.

In a third hydrotreating operation, a third sample of crude lubricating oil was separated into a distillate fraction boiling up to about 1000°F. and comprising about 66.3% by volume of the crude lubricating oil and a residual fraction boiling above about 1000°F. and comprising about 33.7% by volume of the crude lubricating oil, and each of the distillate and residual fractions are separately subjected to hydrotreating in accordance with our process. The catalyst employed in all hydrotreating operations of this example was a fluorine promoted nickel-tungsten on silica-alumina carrier having a cracking activity index (AI) of about 75.

The operating conditions for all hydrotreating operations together with the product inspections are set forth in Table II below:

Table II

| Operating Conditions | Entire Crude Lube Oil | | Distillate Fraction | Residual Fraction |
|---|---|---|---|---|
| Avg. bed temp. °F. | 740 | 755 | 755 | 740 |
| Pressure, psig | ← | | 3000 | → |

Table II-continued

| Operating Conditions | Entire Crude Lube Oil | | Distillate Fraction | | Residual Fraction |
|---|---|---|---|---|---|
| Space Velocity, LHSV | ← | | 1.0 | | → |
| Gas Rate, SCF/B | ← | | 5000 | | → |
| Gas Purity, % $H_2$ | ← | | 82-87 | | → |
| Mol % 625°F. + liq. at $R_x$ outlet | 61.5 | 45.0 | 44.5 | | 67.5 |
| Yield 625°F.+ | | | | Combined | |
| % by vol. charge | 85.0 | 73.0 | 72.5 | | 88.7 |
| % by vol. crude lube oil | 85.0 | 73.0 | 48.1 | 78.0 | 29.9 |
| % by vol. liq. product | 80.6 | 67.9 | 67.1 | | 83.1 |
| $H_2$ consumption SCF/B fresh feed | 975 | 1140 | 1185 | 1067 | 835 |
| $H_2$ Factor (30X Vol% of liq. product 625°F.+) | 2418 | 2037 | 2013 | | 2493 |
| Products | | VI | | Blend | |
| 100 SUS at 100°F. | 82 | 95 | | 95 | |
| 150 SUS at 100°F. | 92 | 103 | | 102 | |
| 200 SUS at 100°F. | 98 | 105 | | 104 | |

From the data shown in Table II above, it will be seen that the more conventional technique of hydrotreating the combined distillate and residual crude lubricating oil as a single entity and employing the operating temperature required to avoid excessive conversion of the residual components results in a product wherein the lower viscosity components of the hydrotreated material have a comparatively low VI and wherein the decrease in VI with decreasing viscosity is quite drastic. On the other hand, however, when the same feed stock is treated at a higher temperature in order to increase the viscosity index of the lowest viscosity product fraction there is a substantial loss of lubricating oil product. Furthermore, this overall decrease in lubricating oil product is accompanied by a substantial increase in hydrogen consumption.

As distinguished from the results just described, the technique of our invention, comprising a separate processing of residual and distillate components under different degrees of severity, is effective to increase the viscosity index of the lowest viscosity fraction of the product without needlessly effecting as great an increase in the VI of high viscosity product fractions. Furthermore, it will be seen this desirable result is achieved while providing a substantially greater quantity of lubricating oil product as compared with that obtained when treating the entire crude lubricating oil at conditions necessary to provide the desired VI enhancement. Additionally, such desirable result is achieved with a significantly lower hydrogen consumption.

EXAMPLE 2

In this example, a sample of the residual fraction of Example 1, a sample of the full crude lubricating oil of Example 1, and two samples of the distillate fraction of Example 1 are subjected to hydrotreating employing the same catalyst, pressure, space velocity, gas rate and gas purity employed in Example 1. The residual fraction, the full crude lubricating oil and one sample of the distillate fraction are all subjected to hydrotreating at a temperature of 740°F. The second sample of the distillate fraction is subjected to hydrotreating at 755°F. The VI for various viscosity fractions of the products of such treatments are set forth in Table III.

Table III

| Charge Stock | Operating Temperature | 100 SUS at 100°F. | 150 SUS at 100°F. | 200 SUS at 100°F. |
|---|---|---|---|---|
| Residual fraction | 740°F. | 96 VI | 102 VI | 103 VI |
| Entire crude lube oil | 740°F. | 82 VI | 92 VI | 98 VI |
| Distillate Fraction | 740°F. | 73 VI | 89 VI | 99 VI |
| Distillate Fraction | 755°F. | 89 VI | 104 VI | 110 VI |

Examination of the above data shows the severely detrimental affect of processing both the residual and distillate fractions together. It will be noted that the VI of the distillate fraction which is processed separately at the same conditions employed in treating the residual fraction provides a hydrotreated distillate product wherein the VI of the 100 SUS material is some 23 points below that obtained from the separate processing of the residual fraction. Furthermore, it will be noted that when the combined distillate and residual stocks are treated as an entity, the distillate fraction appears to have a disproportionately large and deleterious effect upon the VI of the 100 SUS product components. It will also be seen that, when separately hydrotreating the distillate fraction under more severe conditions, there is a general increase in the VI of the various viscosity components in the product. Quite unexpectedly, however, upon blending of the separately treated residual fraction and more severely treated distillate fraction, the resultant product does not have merely a slight increase in VI of the lower viscosity components, as might be anticipated from the results achieved in treating both distillate and residual fractions together, but rather there is a drastic increase in the VI of the lower viscosity materials, an elimination of the sharp drop in VI with decreasing viscosity and the production of a hydrotreated lubricating oil product having a more uniform distribution of VI from one end of the spectrum to the other. Illustrative of this is the following Table IV showing the VI for various viscosity components of the overall blended product.

Table IV

| | 100 SUS at 100°F. | 150 SUS at 100°F. | 200 SUS at 100°F. | 500 SUS at 100°F. | 750 SUS at 100°F. | 155 SUS at 210°F. |
|---|---|---|---|---|---|---|
| VI | 95 | 102 | 104 | 105 | 105 | 107 |

We claim:

1. A process for the production of lubricating oils in order to obtain comparatively low viscosity lubricating oil base stocks of enhanced viscosity index from a crude lubricating oil which process comprises fractionating a crude lubricating oil containing from about 10% to about 90% by volume of a distillate fraction boiling below 950° F. and from 90% to 10% of a residual fraction boiling above 950° F. into a residual and a distillate fraction, subjecting the residual fraction to hydrotreating wherein the operating conditions employed comprise a temperature in the range from about 650° F. to about 850° F., a pressure in the range from about 2,000 to about 10,000 psig, a liquid hourly space velocity in the range from about 0.1 to about 10 volumes of residual charge stock per volume of catalyst per hour and a hydrogen feed rate in the range from about 2,000 to about 10,000 standard cubic feet per barrel of residual charge stock, said operating conditions being selected so as to maintain a yield of at least 50% by volume based upon the residual fraction of hydrotreated material boiling above about 625° F., separately subjecting the distillate fraction to hydrotreating under more severe conditions than employed in hydrotreating the residual fraction wherein the operating conditions employed comprise a temperature in the range from about 700° to about 900° F. and at least 15° F. greater than the temperature employed in hydrotreating the residual fraction when the remaining hydrotreating process parameters are substantially the same as like hydrotreating process parameters for the residual fraction, a pressure in the range from about 2,000 to about 10,000 psig, a liquid hourly space velocity in the range from about 0.1 to about 10 volumes of distillate charge stock per volume of catalyst per hour and a hydrogen feed rate in the range from about 2,000 to about 10,000 standard cubic feet per barrel of distillate charge stock, said operating conditions being selected so as to maintain a yield of at least 50% by volume based upon the distillate fraction of hydrotreated material boiling above about 625° F., and recovering hydrotreated crude lubricating oil boiling above about 625° F. as lubricating oil base stock product from each hydrotreating process.

2. The process of claim 1 wherein the operating conditions for hydrotreating the residual fraction and for hydrotreating the distillate fraction are selected so that at least 22 mol per cent of the normally liquid hydrotreated material boils above about 625°F.

3. The process of claim 1 wherein the operating conditions for hydrotreating the residual fraction and for hydrotreating the distillate fraction are selected so as to maintain a hydrogen consumption (measured as standard cubic feet per barrel of fresh feed) in each such hydrotreating of less than the product of 30 multiplied by the volume % of 625°F.+ material in the total $C_{5+}$ reactor effluent.

* * * * *